US005382001A

United States Patent [19]

Lichti

[11] Patent Number: 5,382,001

[45] Date of Patent: Jan. 17, 1995

[54] POSTLESS HANDRAIL

[76] Inventor: Robert D. Lichti, 642 Peninsula Dr., Lake Almanor, Calif. 95947

[21] Appl. No.: 928,882

[22] Filed: Aug. 11, 1992

Related U.S. Application Data

[63] Continuation of Ser. No. 572,445, Aug. 27, 1990, abandoned.

[51] Int. Cl.[6] ..... E04H 17/14

[52] U.S. Cl. ..... 256/65; 256/59; 256/22; 403/282

[58] Field of Search ..... 256/22, 21, 24, 65, 256/68, 70, 73, 69, 59; 403/282, 274

[56] References Cited

U.S. PATENT DOCUMENTS

| | | | |
|---|---|---|---|
| 125,898 | 4/1872 | Manly . | |
| 145,739 | 12/1873 | Kuh . | |
| 530,391 | 12/1894 | Carr . | |
| 3,482,819 | 12/1969 | Leurent | 256/21 X |
| 3,955,755 | 5/1976 | Breillatt, Jr. et al. . | |
| 3,991,982 | 11/1976 | Yamamoto | 256/65 |
| 4,293,122 | 10/1981 | Coleman et al. . | |
| 4,334,671 | 6/1982 | De Guise | 256/22 X |
| 4,451,025 | 5/1984 | Spera | 256/22 X |
| 4,508,321 | 4/1985 | Morimoto | 256/65 |
| 4,533,121 | 8/1985 | Basey . | |
| 4,586,697 | 5/1986 | Tornya . | |
| 4,623,128 | 11/1986 | Dutch et al. | 256/65 |
| 4,805,879 | 2/1989 | Spera | 256/22 X |

FOREIGN PATENT DOCUMENTS

| | | | |
|---|---|---|---|
| 510603 | 3/1955 | Canada . | |
| 2404084 | 5/1979 | France | 256/65 |

*Primary Examiner*—Randolph A. Reese
*Assistant Examiner*—Harry C. Kim
*Attorney, Agent, or Firm*—Beehler & Pavitt

[57] ABSTRACT

A preassembled handrail structure is supplied in relatively long lengths and consists of top and bottom rails separated by a row of pickets. The structure makes use of a special joint where the ends of the pickets are attached to the rails. These joints are made so that they can be put together by application of pressure. In this way an entire length of the handrail structure can be assembled in one operation by pressing both top and bottom rails into engagement with the corresponding ends of the pickets in one compressing operation. Handrail structures are delivered as complete units to the site. In place of posts to mount the handrail structure on a deck, use is made of a series of mounting brackets bolted to the deck on which the lower rail is anchored by use of a specially designed attachment.

27 Claims, 9 Drawing Sheets

Fig. 1.
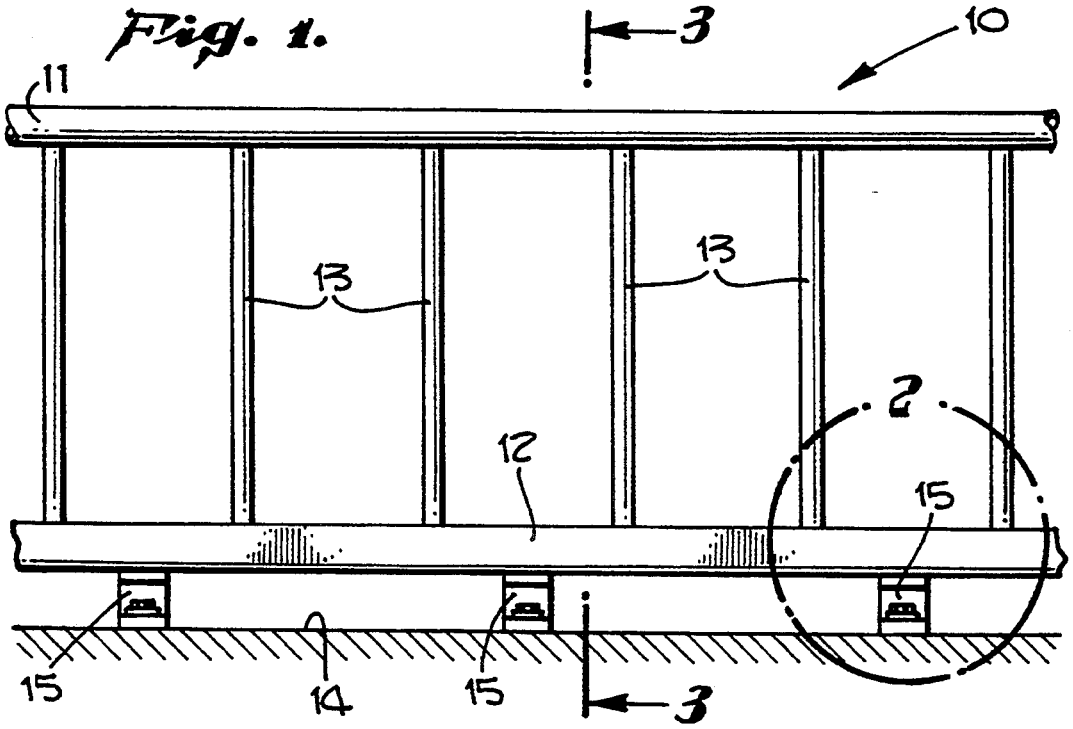
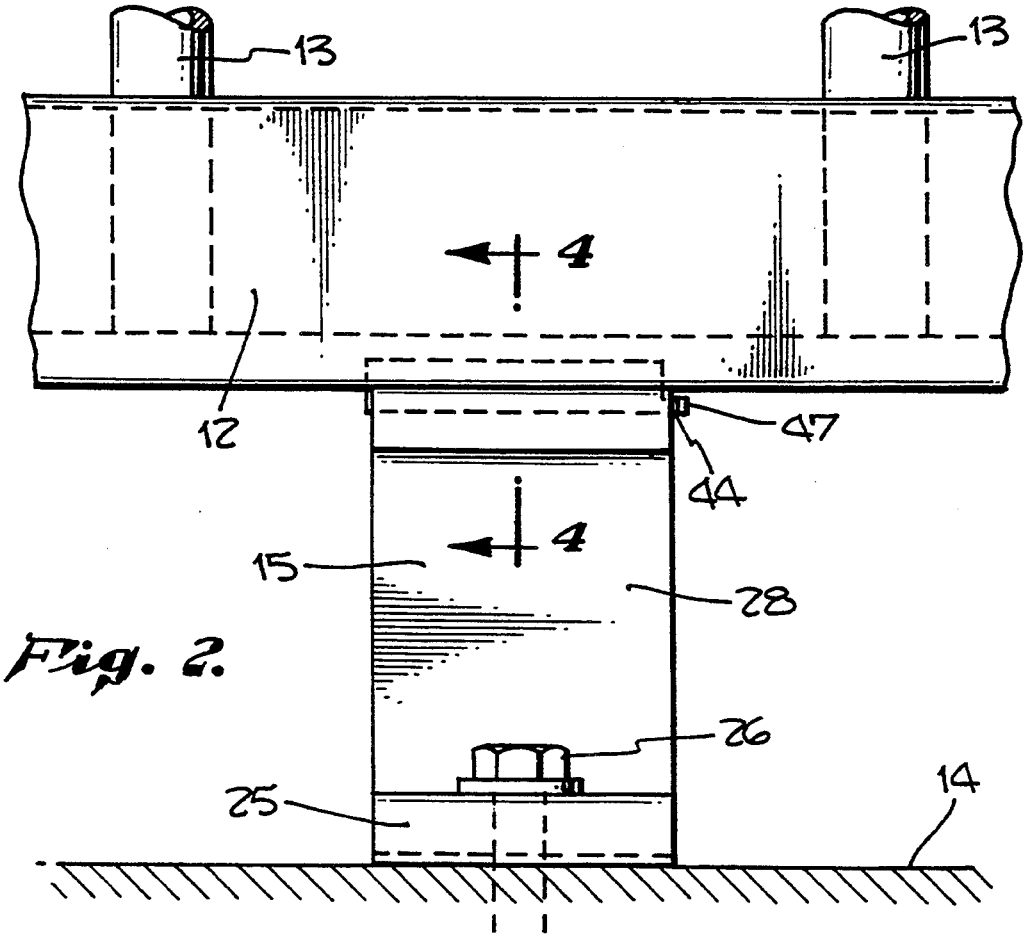
Fig. 2.

14

118
122
117
123
121
115
120
109
113
114
116
68
66
111
73
103
77
77
73
102
101
100
104
107
106
71'
108
105
72'
96
98
97
99
14
14

118
115
117
109
113
116
68
68
66
112
111
100
105
104
110
106
72'
96
97
14
99

101
100
102

Fig. 26.
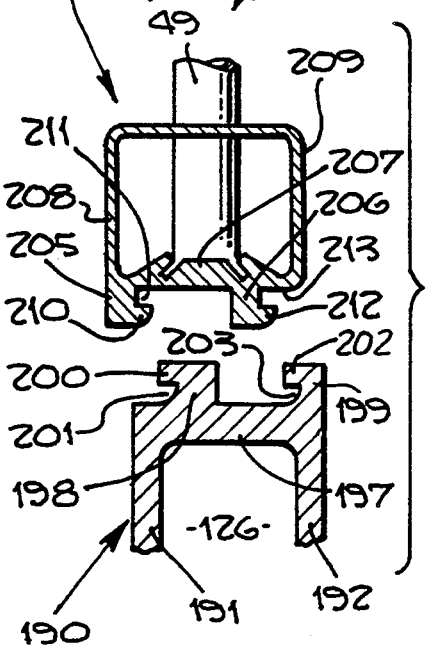
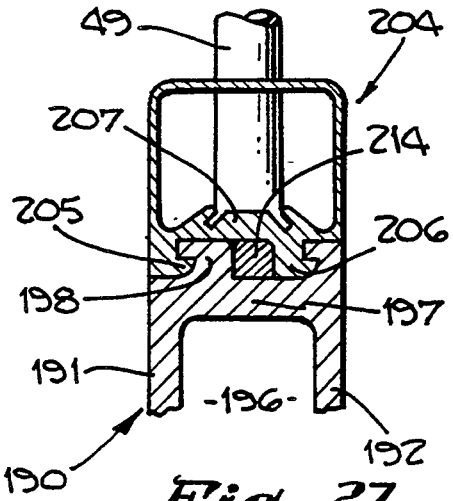
Fig. 27.
Fig. 25.
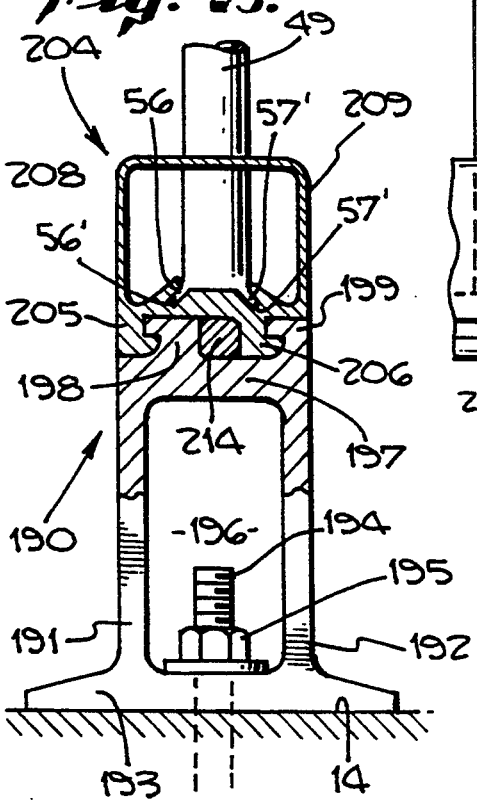
Fig. 24.
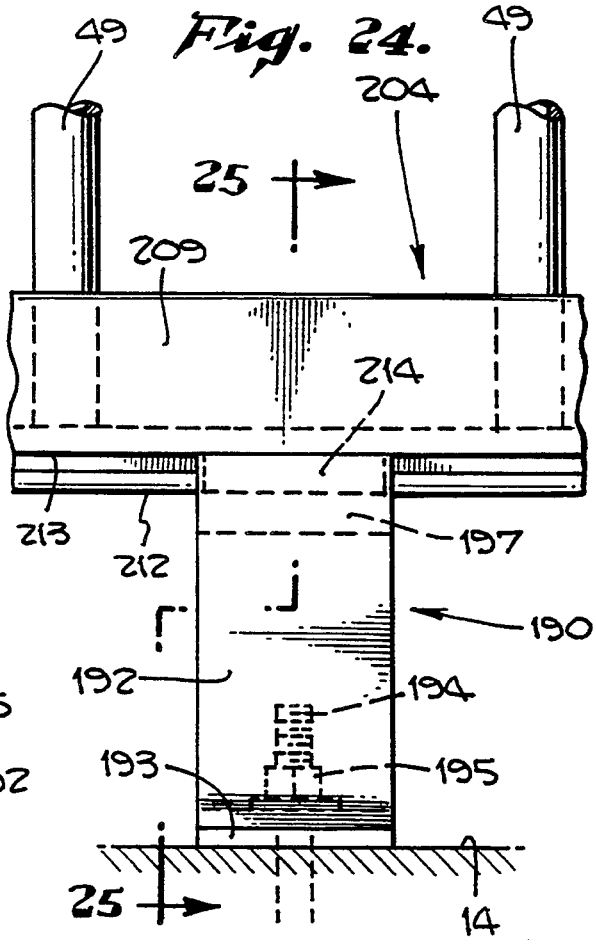

POSTLESS HANDRAIL

This is a continuation of co-pending application Ser. No. 07/572,445 filed on Aug. 27, 1990, now abandoned.

BACKGROUND OF THE INVENTION

1. Field of the Invention

The subject matter of the disclosure is that of a handrail of an especially reliable character and strong enough for use in public installations where there are large numbers of people making use of the rail.

2. State of the Prior Art

With greater masses of people needing to be accommodated in frequently used public walkways, such as stadiums, airports, gallerias and overpasses, to mention a few, many of such locations may be well above the ground surface. Railings which in the past have been acceptable lack a degree of flexibility which permits them to be installed with equal readiness for all circumstances. Handrail structures which in effect have been of a type built on the job often require more skilled labor than may be warranted. Also objectionable have been those handrails which, once installed, could not be readily dismantled when no longer needed and re-erected at a new location. Installations requiring many man hours for construction and installation have been found to be particularly unacceptable.

SUMMARY OF THE INVENTION

It is therefore among the objects of the invention to provide a new and improved handrail of dependable and reliable construction acceptable for both commercial and private use and strong enough when installed so as to present no safety problem.

Another object of the invention is to provide a new and improved postless handrail and method of making which, while of rugged construction, is of relatively lightweight with the accompanying advantage of lower cost and ease of installation.

Another object of the invention is to provide a new and improved postless handrail and method of making which is a prefabricated structure capable of being stocked and inventoried in quantity lots ready for delivery and rapid installation.

Another object of the invention is to provide a new and improved postless handrail and method of making which is of such character that it can be mass produced at a corresponding low cost while at the same time being one of acceptable attractive appearance when installed in frequently used public places.

Another object of the invention is to provide a new and improved postless handrail and method of making which features top and bottom rails separated by pickets in an overall assembly where the bottom rail can be mounted close to the supporting deck, the top rail at an acceptable height commensurate with safety and the picket assembly not only light in weight but also in a cooperative relationship with the rails providing a rigid, dependable overall assembly.

Further among the objects of the invention is to provide a new and improved postless handrail and method of making which. makes possible mass production of the rail and picket assembly in virtually any desirable length and of such character that it can be cut to shorter lengths at the installation location and. re-attached to other cut or standard sections in order to meet the individual needs of different local conditions.

Further still among the objects of the invention is to provide a new and improved postless handrail and method of making which enables preassembly of top and bottom rail picket combinations in various arrangements and styles by use of both standard and special metal extrusions which can satisfy a variety of different architectural styles while at the same time providing a structure with a high degree of rigidity and strength.

Also included among the objects of the invention is to provide a new and improved postless handrail and method of making where mountings which take the place of posts can be spaced at will to accommodate a variety of demands and can be quickly and firmly attached to the rail structure wherever occasion may require.

Included especially among the objects is the provision of a handrail and picket structure which takes advantage of the inherent characteristics of hollow, preferably metallic, members of different lengths and cross-sectional configurations whereby in the resulting assembly the individual parts cooperate with each other in the production of a strong, lightweight and correspondingly low cost installation.

With these and other objects in view, the invention consists of the construction, arrangements, and combination of the various parts of the device serving as an example only of one or more embodiments of the invention, whereby the objects contemplated are attained, as hereinafter disclosed in the specification and drawings and pointed out in the appended claims.

BRIEF DESCRIPTION OF THE DRAWINGS

FIG. 1 is a side elevational view of a section of the handrail assembly shown mounted on an appropriate supporting surface.

FIG. 2 is a fragmentary elevational view on the circular line 2 of FIG. 1.

FIG. 24 is a fragmentary side elevational view of a mounting of modified form.

FIG. 25 is a vertical sectional view on the line 25—25 of FIG. 24.

FIG. 26 is a cross-sectional view of parts of the mounting of FIG. 25 in preassembled condition.

FIG. 27 is a cross-sectional view similar to FIG. 26 but with parts assembled.

DETAILED DESCRIPTION OF THE PREFERRED EMBODIMENTS

Figure 3:
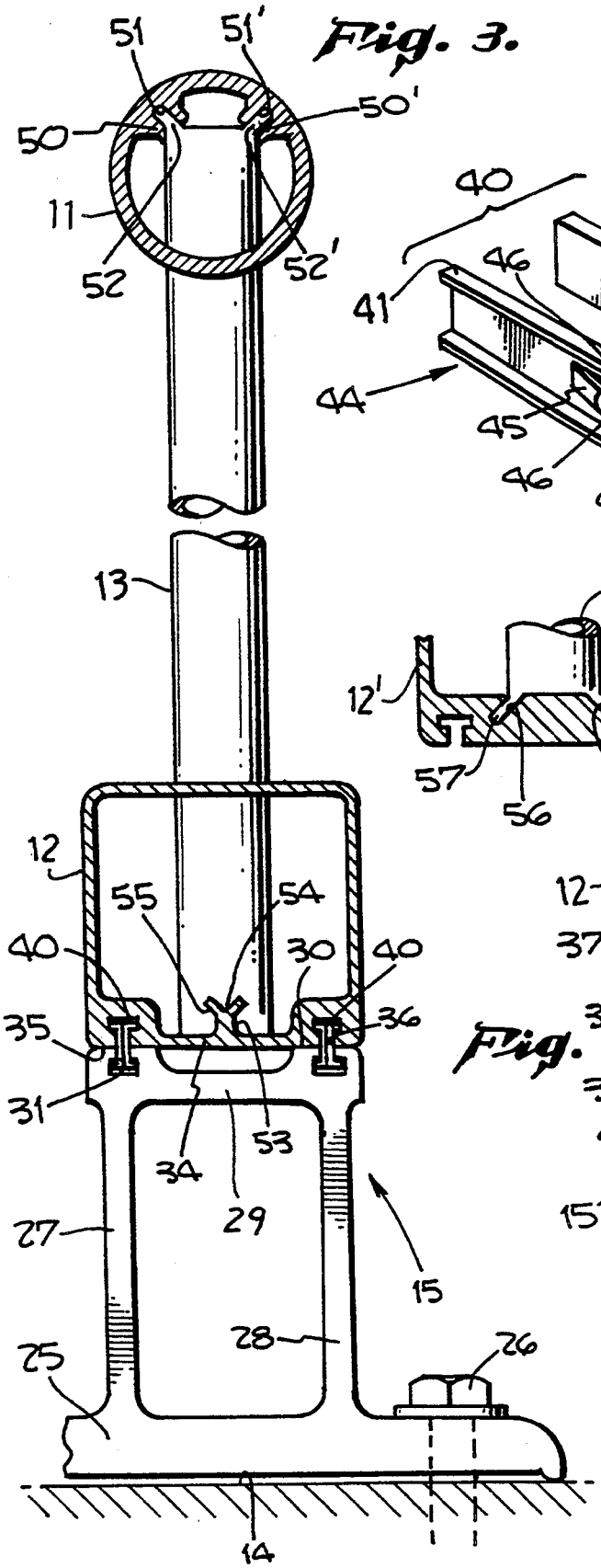
FIG. 3 is an elevation partially sectional view on the line 3—3 of FIG. 1.

In one of several embodiments of the invention there is shown in FIGS. 1 through 7, inclusive, significant elements of a postless handrail assembly 10 consisting of an upper rail 11, and a lower rail 12 separated by an array of pickets 13. A mid-section only of the assembly is shown supported, on this occasion, upon a surface 14 by mounting blocks 15. The assembly 10 may be made as long as good practice warrants, depending on assembly facilities and shipping capabilities. Picket length should be made customarily to locate the upper rail 11 at a level high enough above the surface 14 so that should persons of normal height press against the assembly, there would be every prospect of an individual being effectively restrained by the upper rail. A commonly acceptable rail height is one of about 40".

Good practice suggests that the rails 11, 12 and pickets 13 be assembled as a unit and mounting blocks 15 separately formed and mounted individually on the surface 14. Hollow members such as tubing elements are contemplated. The cross-section configuration is optional. Satisfactory cross-sectional forms for rails may be square, rectangular or round. Pickets may be square, round, rectangular or eliptical, and with walls of uniform or of varied thickness.

Tubing for the pickets may be conventional drawn rods of the desired shape and thickness and of conventional lengths of twenty to forty feet. Rails are preferably extruded stock to accommodate structural needs on both the interior and exterior.

When handrail assemblies are to be supported by mountings only attached to the bottom rail, it is important to have the assemblies be of a construction to inherently provide the rigidity conventionally supplied by the posts attached to the supporting surface. The invention contemplates different ways by which this can be accomplished.

Figure 28:
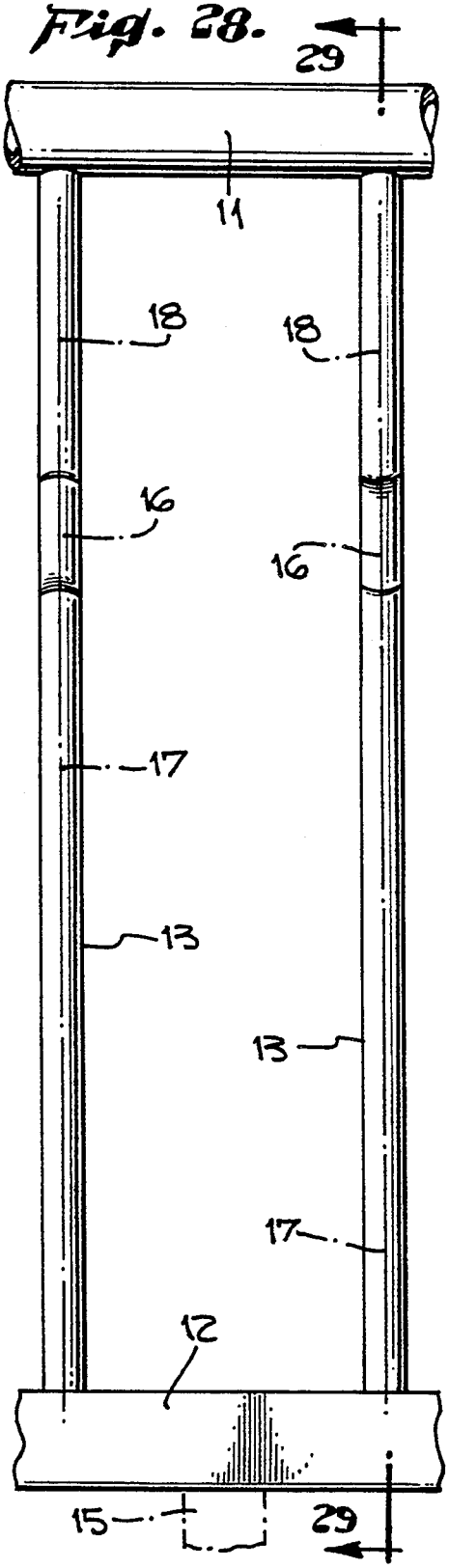
FIG. 28 is a side elevational view of a portion of the assembly of rails and pickets of one type.
Figure 29:
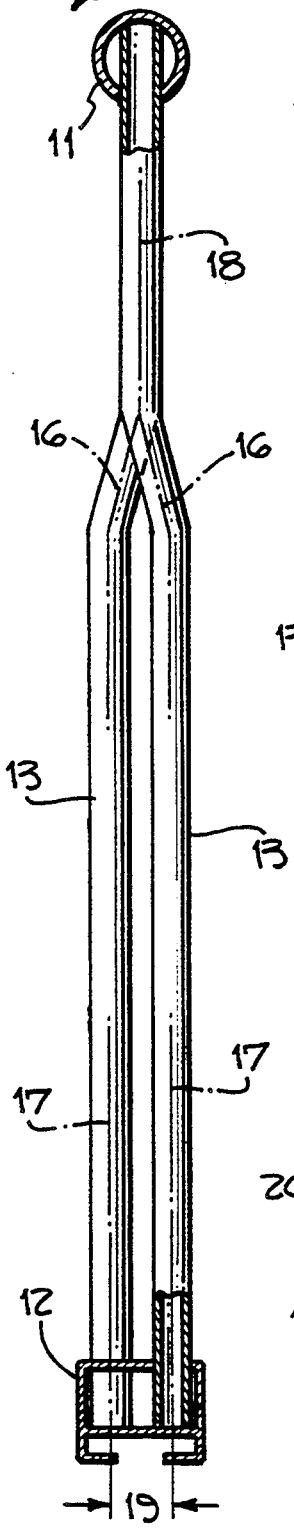
FIG. 29 is a vertical sectional view on the line 29—29 of FIG. 28.

In the structure of FIGS. 28 and 29, the upper rail 11 and lower rail 12 have pickets 13 attached between them to contribute to the assembly. A mounting block 15 is shown supporting the lower rail 12. On this occasion there is a bend 16 in the longitudinal axis of the picket 13 so that a lower end 17 is offset laterally relative to an upper end 18. For adjacent pickets the offset is in opposite lateral directions providing a distance 19 between lower ends 17, whereas the upper ends 18 are not offset but are in alignment with each other and with the longitudinal axis of the upper rail 11. With a structure of the kind described, there is a torsional resistance to pressure applied to any portion of the assembly, sufficient to dispense with posts.

Figure 30:
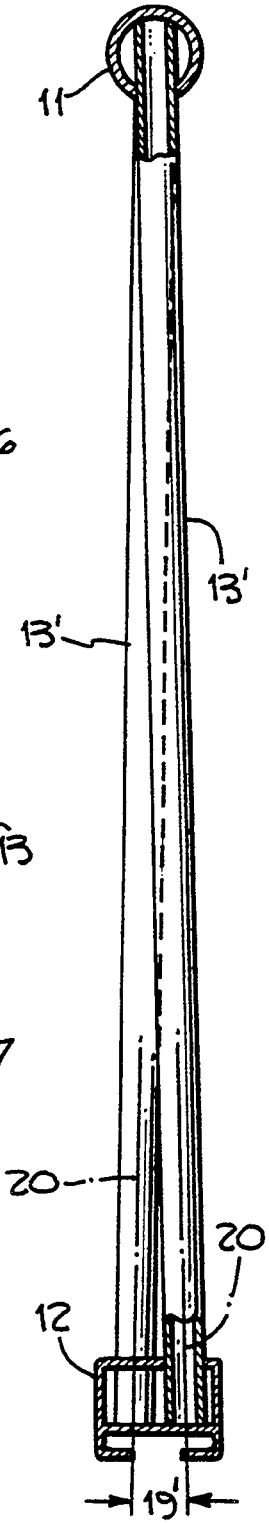
FIG. 30 is a vertical sectional view of pickets of modified type.

In the alternative structure of FIG. 30 straight pickets 13' are made use of. On this occasion the longitudinal axis 20 of one picket is offset at the lower end where it is fastened to the lower rail 12 from the axis 20 of the adjacent picket 13' by a distance 19'. The distance 19' may be more or less the equivalent of the distance 19 of FIG. 29. Different distances may be applicable to different circumstances as, for example, the picket length, type of material, breadth of one or both rails, and comparable conditions. Other offset expedients may also be applicable.

Having in mind that the handrail assemblies are made available in standard lengths so that they can be cut either at the shop or on the job to fit the need of a particular installation, it is important that the mounting block 15 be positionable anywhere under the lower rail. In other words, the mounting blocks 15 may be fastened to the supporting surface 14 wherever it is most expedient. This flexibility is made possible because the fastener (as described below) at the top of the mounting block 15 can be attached to the lower rail anywhere throughout its length.

Figure 5:
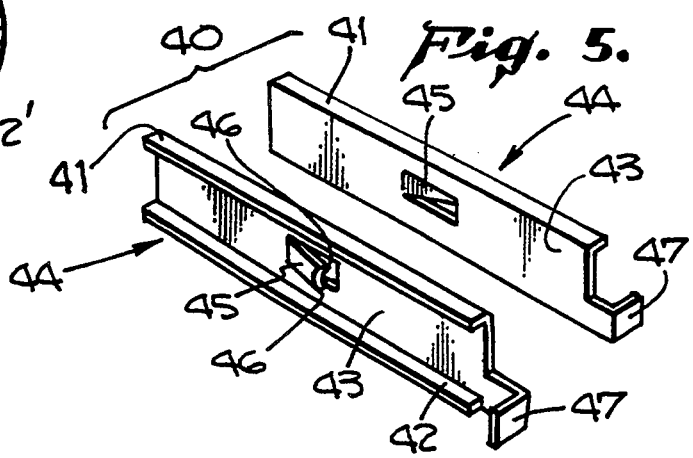
FIG. 5 is a perspective view of interlocking clamps shown in cross-section in FIG. 4.
Figure 4:
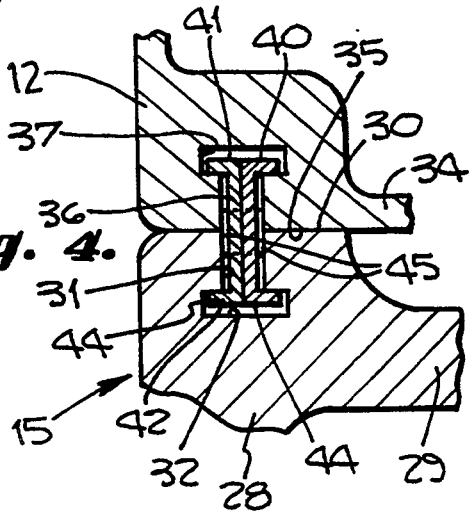
FIG. 4 is a fragmentary cross-sectional view on the line 4—4 of FIG. 2.

In the modification of FIGS. 3, 4 and 5 the mounting block 15 consists of a base 25 adapted to be attached to the supporting surface 14 by bolts 26. Extending upwardly from the base 25 are legs 27 and 28 which support at their upper ends a platform 29. In upwardly facing areas 30 of the platform are slots 31 extending from one end to the other, the slots being open at both ends. For this form of the device the slots 31 each comprise a transverse pocket 32 from which the slot communicates with the upper face of the area 30.

A lower rail 12 on this occasion is of rectangular cross-sectional shape. The lower wall 34 which extends throughout the length of the rail has a downwardly directed face 35 designed to rest on the areas 30 on opposite sides of the mounting block 15. On each side of the face 35 is a slot 36 complementary with respect to the slots 31 of the mounting block. At the innermost end of each slot is a transverse pocket 37.

Brought together as shown, the slots 31 and 36 and their respective pockets 32 and 37 form a common pocket for reception of a key 40. The key in this instance consists of two channel strips, back to back, substantially filling the common pocket, as shown in FIG. 4. In that position the keys, one on each side of the mounting block, anchor the lower rail to the block at whatever the location may be.

For the anchoring to take place, legs 41, 42, joined as they are by a base 43, of each half-key 44, have a height less than the width of the slots 31 and 36. That way one of the half-keys is first inserted in the slot 36 of the lower rail anywhere close to the mounting block 15 and from there, if desired, pushed into the slot 31 of the mounting block. Thereafter the other half-key is inserted in the same slot 36, back to back to the first half-key. The second half-key is wedged into the slot 31 for the anchoring to take place.

On each base there is a tooth 45 having sharp corners 46 stamped from the material of the base. By having the teeth bite into the walls of the slots 31, 36, the key is held more securely in place. The key can be forcibly dislodged, if necessary, should the need arise to dismount the rail assembly. Fingers 47 at the ends of the half-keys are useful in pulling the keys free at the time of dismounting.

The modification of FIGS. 3, 4 and 5 makes use of an assembly consisting of an upper rail 11 attached to the lower rail 12 by an array of pickets 13. In this assembly the upper rail 11 has been provided on the upper inside wall with laterally disposed ribs 50, 50' in which are slots 51, 51' extending in an outwardly and upwardly oblique direction. Corresponding ears 52, 52' on the end edge of each picket 13 have been forced into the slots to anchor each picket to the upper rail. Present, though not shown in FIG. 3, are holes on the lower side of the upper rail 11, diametrically opposite to the picket retaining slots through which the pickets extend to their anchored positions.

For anchoring the lower end of each picket to the lower rail 12 a modified form of attachment has been chosen. On the inside of the lower wall 34 there is a ridge 53, the upper end of which has initially a slit 54 forming fingers 55. The fingers 55 are shown forced into complementary recesses extending inwardly from the adjacent end edge of the various pickets 13 to anchor the bottom end of each picket 13 to the lower rail 12.

Figure 6:
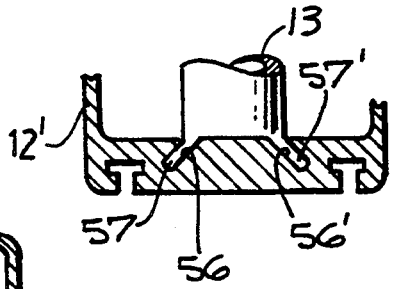
FIG. 6 is a fragmentary cross-sectional view showing one form of attachment of a picket to a lower rail.

FIG. 6 shows an alternate form of attachment for the lower end of the pickets. Outwardly oblique downwardly extending slots 56, 56' on the inside wall of the lower rail 12' have had ears 57, 57' of the picket 13 forced into them to anchor the lower end of the pickets to the lower rail.

Figure 7:
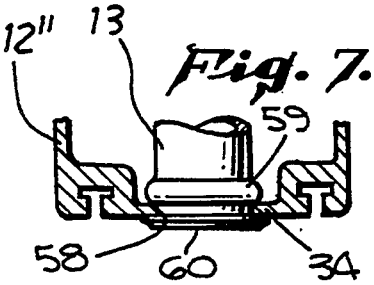
FIG. 7 is a fragmentary cross-sectional view showing another form of attachment.

In still another form of attachment for pickets to the lower rail 12'' as in FIG. 7, holes 58 have been made in the lower wall of the lower rail at the picket locations. By use of an appropriate tool, an annular band 59 has been pressed outwardly at the end of the picket to bear against the inside of the lower wall 34 of the rail. By this agency the picket is anchored to the lower rail by creating a burr 60 at the end edge of the picket overlying the outside face of the lower wall.

The embodiment of the invention of FIGS. 8 through 12 reveals alternative expedients for mounting a lower rail 66 on a mounting block 67. An alternative expedient is also featured for anchoring the upper end of pickets 68 to an upper rail 69. On this occasion the mounting block with its base 70 bolted to the supporting surface 14 has opposite independent legs 71 and 72. The tops of the legs are free to deflect inwardly and outwardly to a degree.

At the upper end of each leg, the leg 71 serving as an example, there is a laterally outwardly facing groove 73 with an overlying lip 74. The other side wall of the groove provides a land 75. Extending downwardly from a lower wall 76 of the lower rail 66 is a foot 77 which projects into the groove 73, with the foot resting on the land 75.

For freezing the parts in place, once the rail is in position on the mounting block, there is a snap plate 78. The snap plate has two sides terminating in a central ridge 79 projected downwardly as in FIGS. 10 and 12. Side edges 80, 81 are lodged in oppositely disposed niches 82, 83 at the tops of the legs 71, 72.

Figure 8:
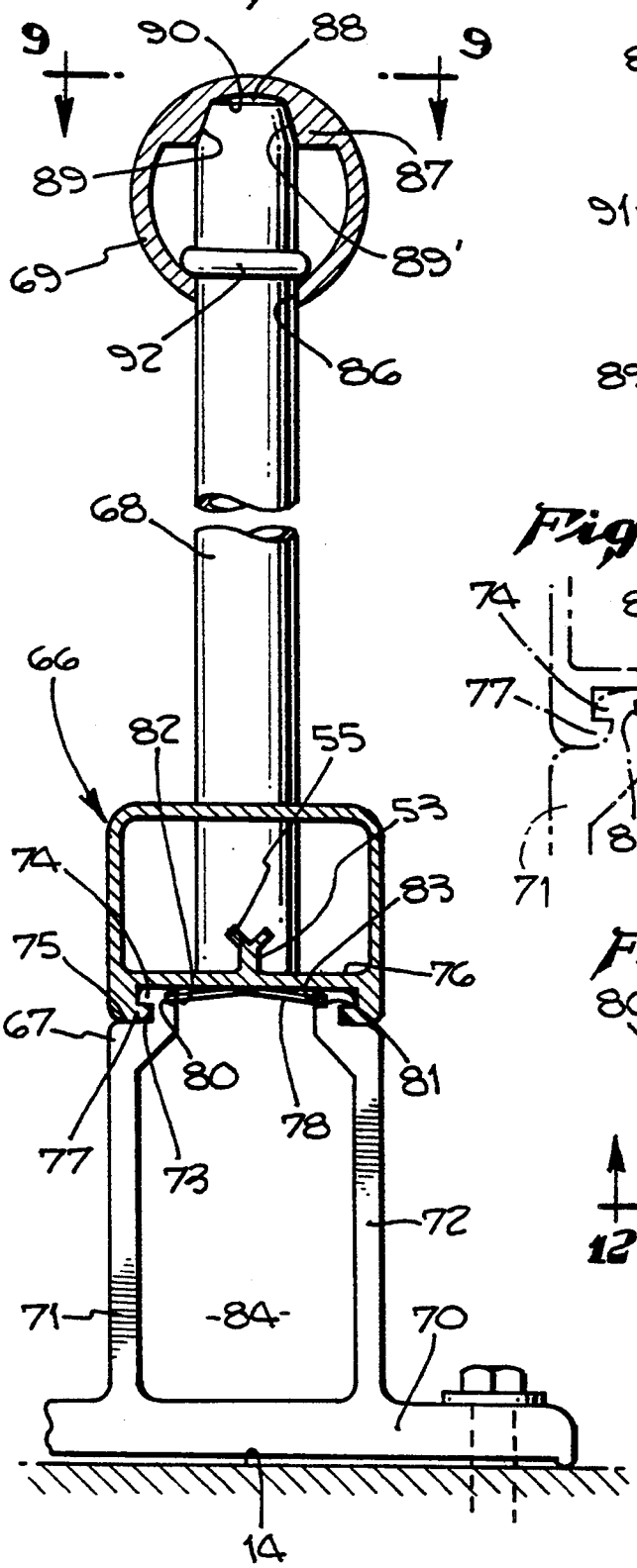
FIG. 8 is an elevational partially sectional view similar to FIG. 3 but showing a modified form of mounting and rail structure.
Figure 9:
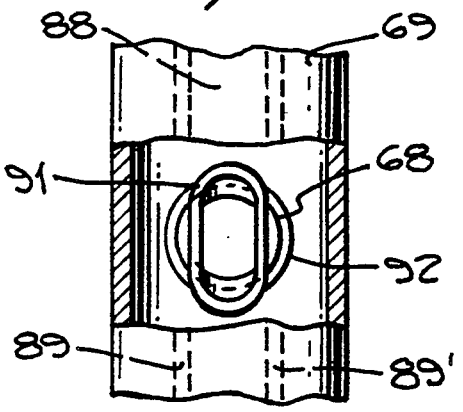
FIG. 9 is a top plan view partially broken away the line 9—9 of FIG. 8.
Figure 10:
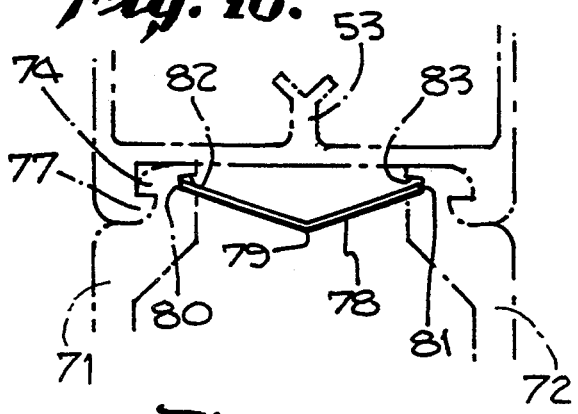
FIG. 10 is a fragmentary cross-sectional phantom view at the midportion of the mounting block showing the parts in an initial position.
Figure 11:
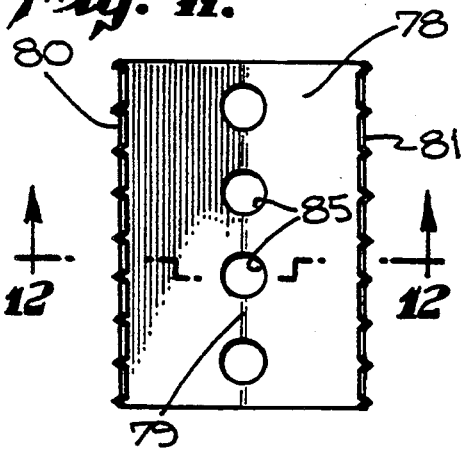
FIG. 11 is a plan view of the deflector plate of FIGS. 8 and 10.
Figure 12:
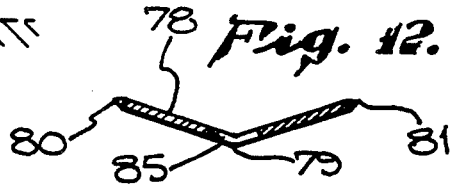
FIG. 12 is a cross-sectional view on the line 12—12 of FIG. 11.

Once the snap plate is in the position of FIG. 10, it can be snapped upwardly to the position of FIG. 8 by an operator reaching into an open space 84 between the legs 71, Perforations 85 provide helpful yieldability along the line of the ridge 79. With the snap plate pressed into position as described, the legs are locked in the positions of FIG. 8 and the lower rail anchored at its installed location on the mounting block. Should occasion arise to dismount the handrail assembly, the snap plate can be snapped in reverse or downward direction to again free the legs. The legs can then be pushed together at the top far enough to dislodge the feet 77 from the grooves 73.

Another structure for anchoring the pickets 68 to the top rail 69 is shown in this embodiment of the handrail assembly. Holes 86 in the top rail 69 admit the pickets. The top rail is further provided on its upper inside face with a lengthwise extending enlarged picket engaging portion 87 opposite the holes 86. Thoughout the enlarged portion is a groove 88 having upwardly converging side walls 89 and 89' terminating at a bottom wall 90. When the upper end of the picket 68 is projected through the hole 86, it is forced into the groove 87. As a result of this procedure, opposite sides of the end edge of the picket are forced laterally inwardly causing deformation of the upper end of the tube into an eliptical form at 91.

Engagement of the end edge of the picket limits the penetration. Once in the final position described, and by use of an appropriate tool pushed inwardly from an open bottom end, an outwardly projecting annular band 92 is formed. With the band 92 forced against the inside wall of the upper rail adjacent the hole 86, the picket becomes anchored to the upper rail.

Figure 13:
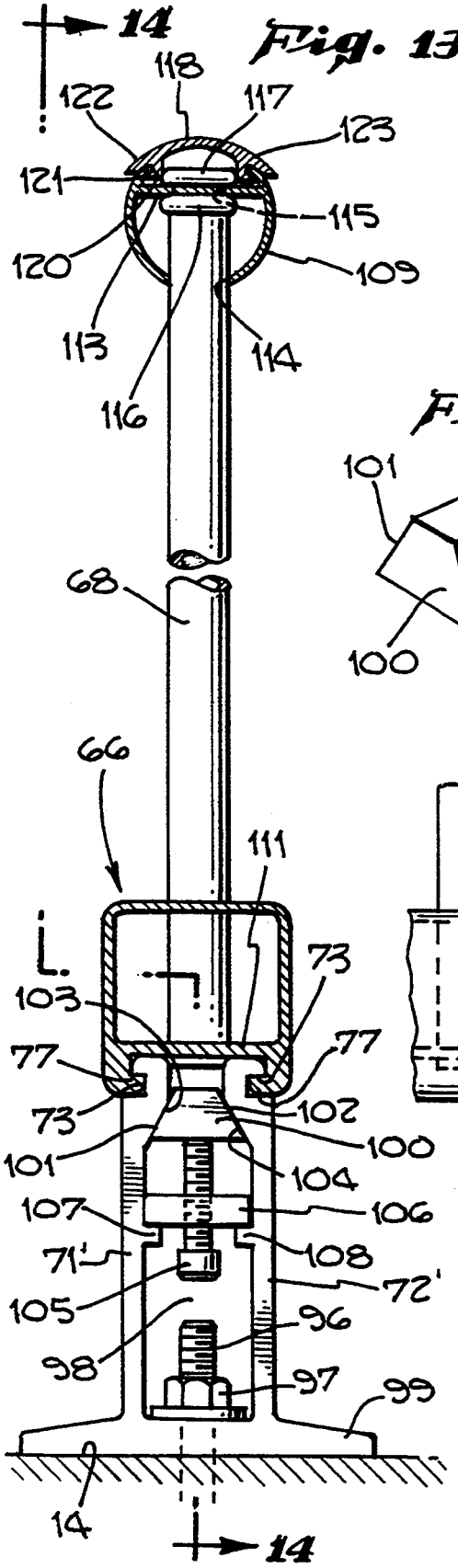
FIG. 13 is an elevational partially sectional view similar to FIGS. 3 and 8 showing still another form of the invention.
Figure 14:
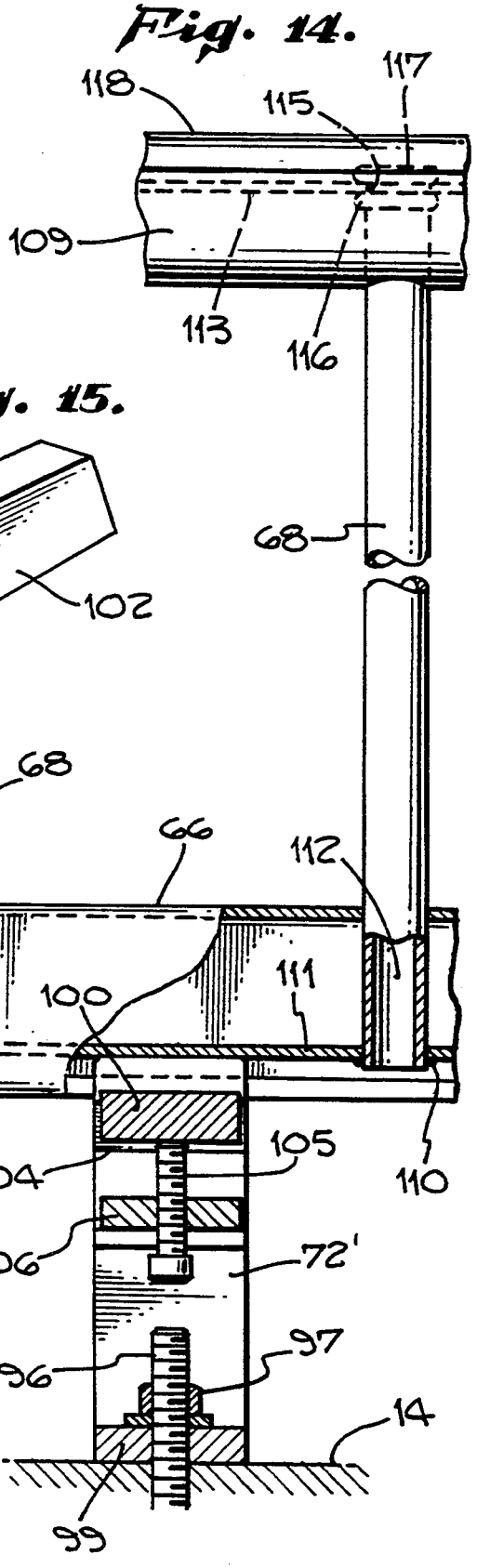
FIG. 14 is an elevational view partially broken away on the line 14—14 of FIG. 13.
Figure 15:
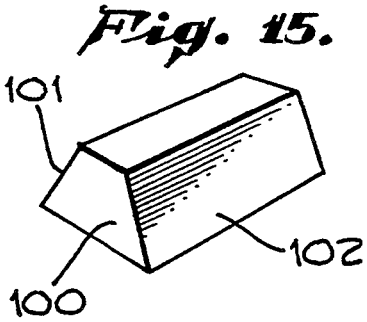
FIG. 15 is a side perspective view of the wedge block of FIGS. 13 and 14.

Instead of the snap plate of FIGS. 8–12, other expedients may be utilized for spreading legs 71' and 72' outwardly to engage the lower rail 66, as in FIGS. 13–15. On this occasion a bolt 96 and nut 97 in the space 98 may be used to fasten a base 99 to the surface 14. As shown, there is a wedge block 100 with sloping side faces 101, 102 adapted to be forced against progressively inwardly tilted deflecting wall sections 103, 104 of the legs 71', 72'.

For driving the wedge block 100 there is a screw 105 backed by a washer plate 106 which nests on shoulders 107, 108 on the legs 71' and 72'.

By the structure described, when tops of the legs 71', 72' are forced laterally outwardly, the grooves 73 are forced outwardly to positions receptive of feet 77 to anchor the lower rail 66 to the legs 71', 72' of the mounting block.

As in the forms of the handrail assembly already described, an upper rail 109 is formed in rigid association with the lower rail 66 by the array of pickets 68. An alternate anchoring expedient is depicted in FIGS. 13 and 14.

Just as an example, the lower ends of the pickets 68 are shown with a brazed attachment 110 to the bottom wall 111 of the lower rail. This leaves an opening 112 at the bottom end of the picket through which a tool can be extended to the top. Here the top is attached to the upper rail 109.

Extending throughout the length of the upper rail 109 is an inside wall 113 with holes 114 for reception of the pickets 68. There are also corresponding aligned holes 115 in the inside wall 113. By use of an appropriate conventional spreading tool, bands 116 and 117 may be formed in the picket wall on opposite sides of the inside wall 113 to anchor between them the upper rail.

A cap 118 is adapted to be clipped in position covering the inside wall 113. By having the cap made of resilient yieldable material, opposite sides may be pressed toward each other until lips 120 underlie edges 121 of the upper rail wall and the cap then released to lock them in engaged position. Overlying rims 122, 123 on opposite sides of the cap 119 conceal the joint with a protective cover and give the upper composite rail a finished appearance.

Figure 16:
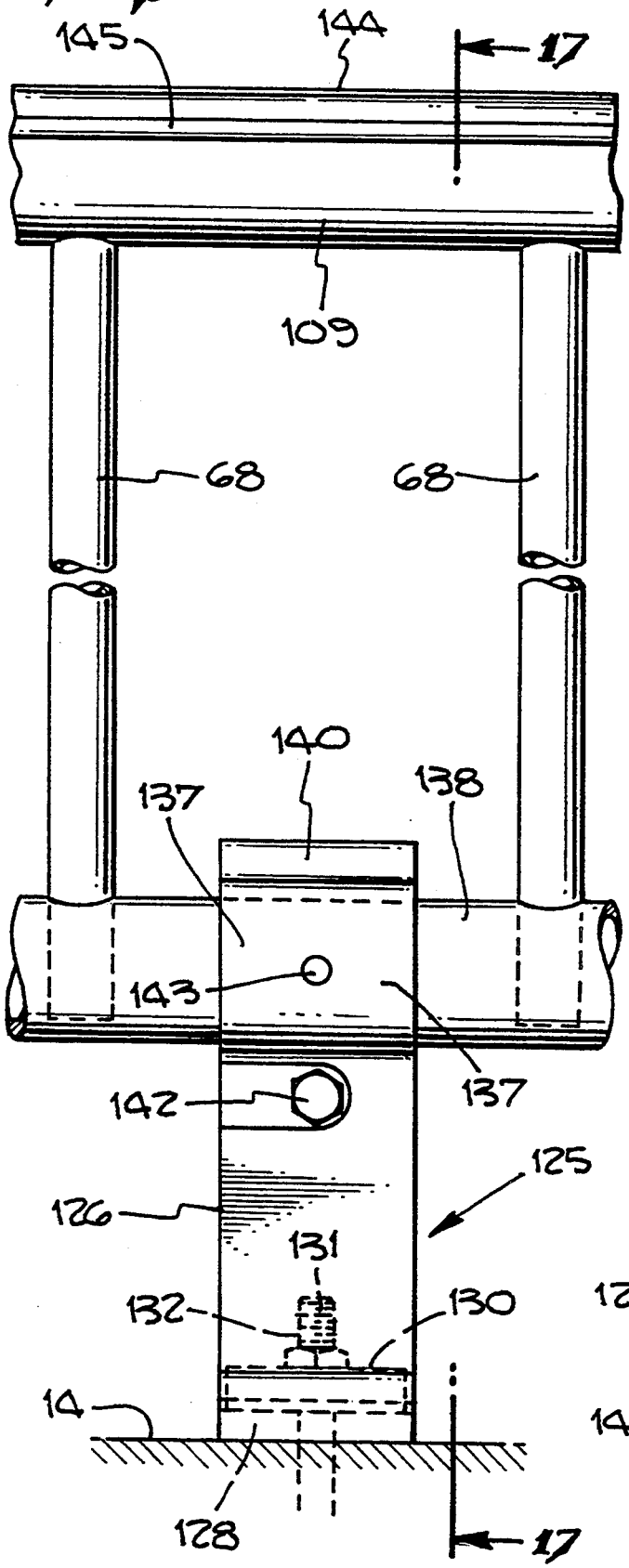
FIG. 16 is a fragmentary side elevational view of a further form of the invention.
Figure 17:
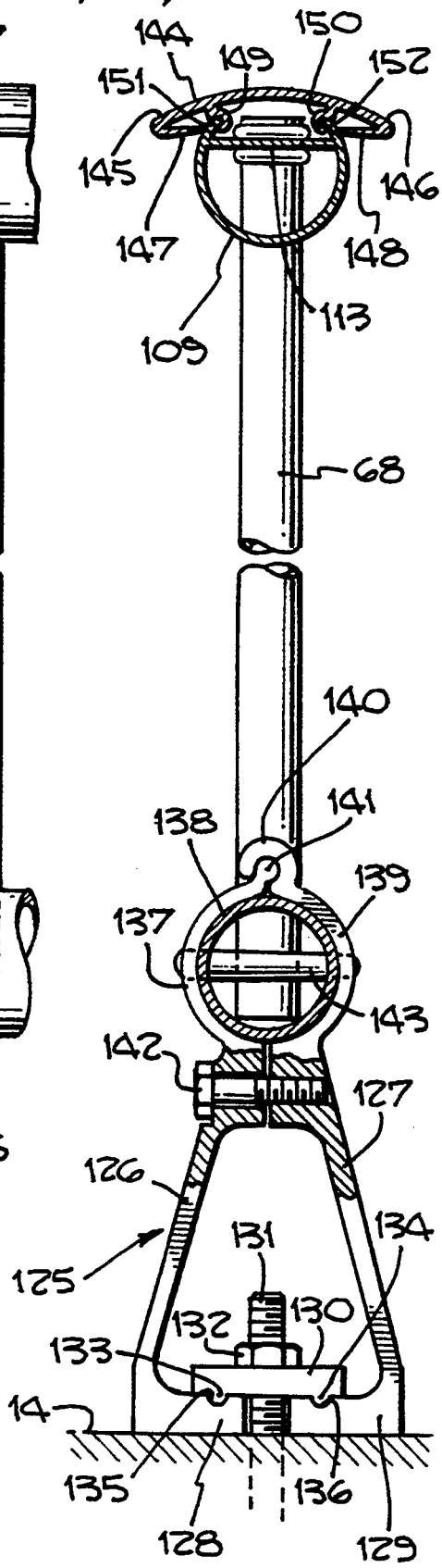
FIG. 17 is a vertical sectional view on the line 17—17 of FIG. 16.
Figure 18:
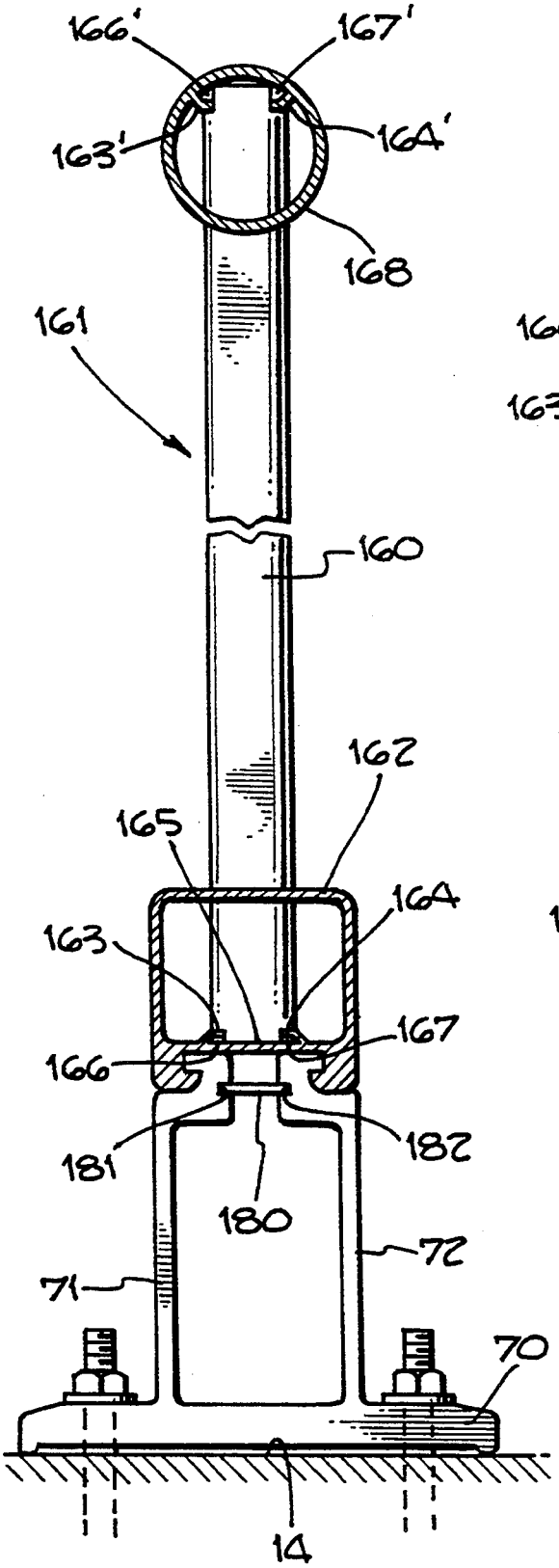
FIG. 18 is a vertical sectional view of a form of the invention featuring a mounting different from FIG. 16.
Figure 19:
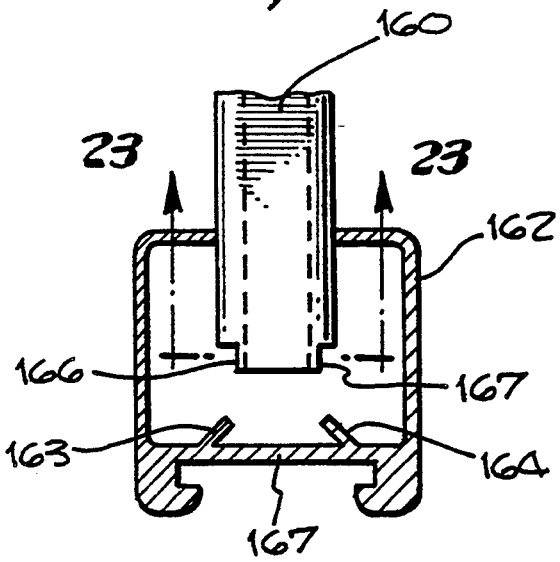
FIG. 19 is a cross-sectional view of the lower rail of FIG. 18 with the picket in initial position for assembly.
Figure 20:
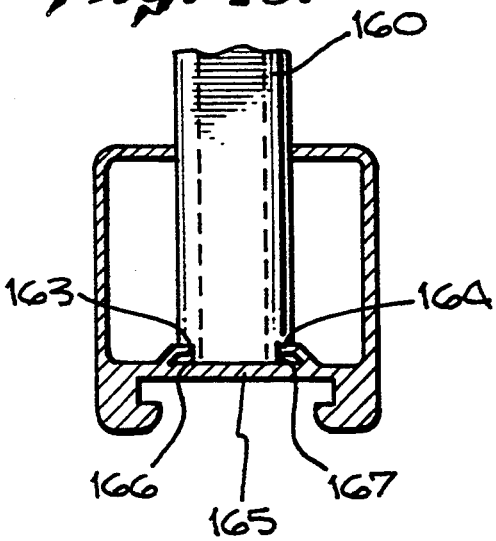
FIG. 20 is a cross-sectional view similar to FIG. 19 but with the picket in engaged position with the lower rail.
Figure 23:
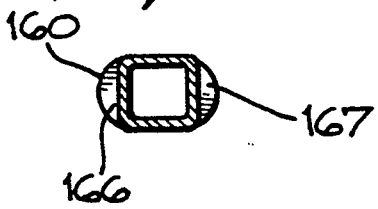
FIG. 23 is a cross-sectional view of a picket of non-circular shape on the line 23—23 of FIG. 19.

For the attachment of tubular or rounded lower rails to a mounting block for ultimate mounting upon a supporting surface 14 other attachment structures may be preferred, as shown in FIGS. 16 and 17. In this form of the invention a mounting block 125 has two half-sections 126 and 127. There is a base 128 for the half-section 126 and a similar base 129 for the half-section 127. The bases are interconnected and fastened to the supporting surface by use of a tie plate 130. A bolt 131 and nut 132 hold the tie plate in position. Buttons 133, 134 fitting in cups 135, 136 prevent the bases 128, 129 from working loose.

At the top of the half-section 126 is a semicylindrical cup 137 which fits around a corresponding side wall portion of a lower rail 138. At the top of the other half-section 127 is a complementary semicylindrical cup 139 which fits around the other side portion of the lower rail. Top ends of the half-sections are releasably clipped together by engagement of a clip rim 140 on the half-section 127 around a pin rim 141 on the half-section 126. Once in position, the semicylindrical cups are fastened in positions of engagement with the lower rail 138 by use of a bolt 142. For added assurance there is a tapered peg 143 driven through the semicylindrical cups and adjacent wall portions of the lower rail. In that way the handrail assembly is held in its initial vertical position.

There is an added feature involved in a cap 144 for the upper rail 109 used in this form of the handrail assembly. Rims 145 and 146 extend laterally outwardly for a distance materially greater than those of FIGS. 13 and 14. For added support and to give the upper rail a finished appearance, the rims include tapered return flanges 147, 148 wide enough to engage the wall of the upper rail. In this way the flanges serve as a vehicle for securely interlocking recessed projections 149, 150 of the cap with corresponding exposed edges 151, 152 of the upper handrail.

In FIGS. 18–23 non-circular pickets 160 are made use of for the prefabricated handrail assembly 161. When effectively used, the non-circular cross-sectional form of the pickets contributes materially to torsional rigidity in the handrail assembly both when the longitudinal axes of adjacent pickets are offset with respect to each other as well as when in alignment as shown. For pickets 160 of elliptical cross-sectional shape they may preferably be mounted with the long axis of the eclipse extending transversely and by having the wall of the picket at the ends of the long axis thicker than intermediate wall portions.

To anchor the bottom end of a picket 160 to a lower rail 162 projections 163, 164 extend inwardly from the inside face of a lower wall 165. On opposite sides of the bottom of the picket are cuts 166 and 167. When the picket is forced downwardly against the projections 163, 164, the projections engage upper edges of the cuts 166, 167 and are driven into engagement with bottoms of the cuts to anchor the picket to the lower rail. There is a similar structure of cuts 166′, 167′ at the top of the pickets where they are driven into engagement with projections 163′, 164′ on the inside wall of an upper rail 168.

Figure 21:
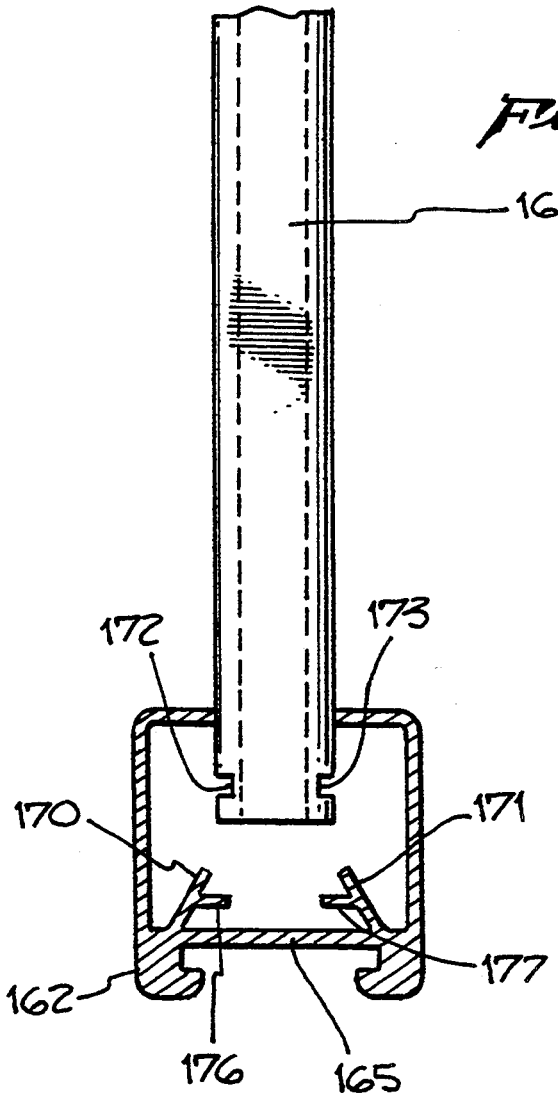
FIG. 21 is a cross-sectional view similar to FIG. 19 with a modified form of deflecting fingers in initial position.
Figure 22:
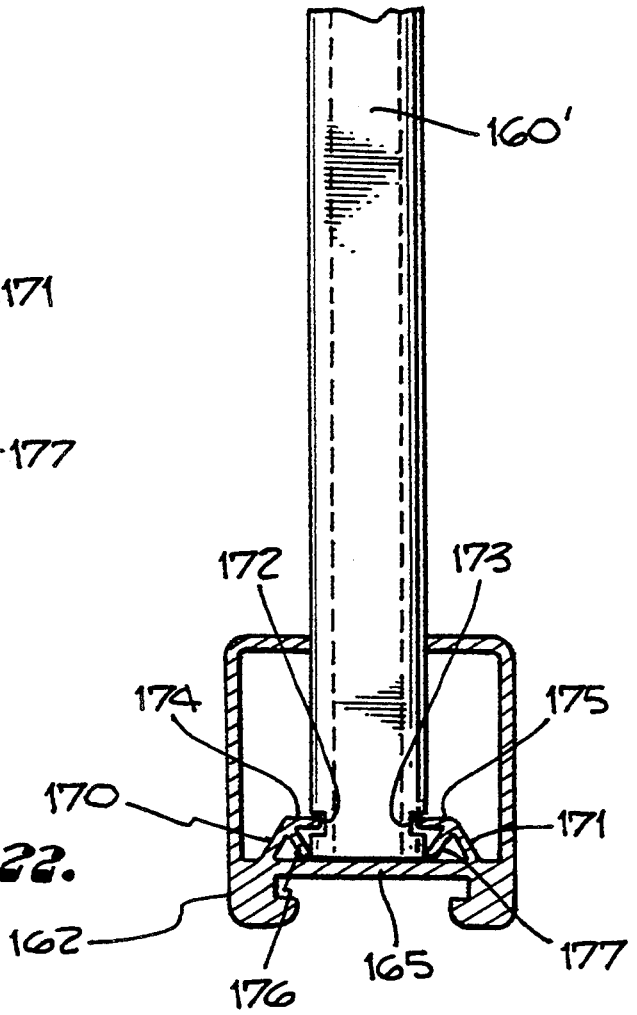
FIG. 22 is a cross-sectional view similar to FIG. 21 with the deflecting fingers in final position.

For an especially effective interlock of the bottom of the picket 160 to the lower wall 165 of the lower rail 162 double forked projections 170, 176 of FIGS. 21 and 22 may be preferred. Notches 172, 173 are made on opposite sides of the picket 160′. Upper tines 174, 175 of the forks engage in the notches 172, 173 and lower tines 176, 177 press against sides of the picket when the picket is forced into engagement with the lower rail against the lower wall 165.

As a variation for anchoring the lower rail 162 to the tops of the legs 71, 72 of the mounting block, a wedge 180 may be driven into wedge receiving slits 181, 182 on inside faces of the legs.

In FIGS. 24–27 there is a small but noteworthy variation in the structure for attaching the handrail assembly on the mounting block. The variation brings the lower rail to rest on the mounting block and then shifts the rail sidewise to interlocked engagement with the mounting blocks.

A mounting block 190 consisting of legs 191 and 192 employs a customary base 193 with a centrally disposed bolt 194 and nut 195 in a space 196 for anchoring the mounting block 190 to the supporting surface 14. On this occasion a top plate 197 connects the upper ends of the legs 191, 192 together so that the positions of the legs are fixed.

Extending upwardly from the top plate 197 are projections 198 and 199. The projection 199 is flush with the exposed surface of the leg 192 and the projection 198 spaced inwardly of the exposed surface of the leg 191. Both projections extend the full length of the mounting block. A lip 200 on the projection 198 provides a leftwardly facing groove 201. A lip 202 on the projection 199 provides a groove 203 which also faces leftwardly.

For engagement with the mounting block 190 a lower rail 204 is provided with projections 205 and 206 extending downwardly from a bottom wall 207 of the rail. The projections are in fixed positions with the projection 205 flush with the exposed surface of a side wall 208 of the lower rail 204. On the other side the projection 206 is located inwardly relative to the exposed surface of the other side wall 209.

As shown in FIG. 26 there is a lip 210 of the projection providing a groove 211. Similarly on the projection 206 is a lip 212 providing a groove 213. These lips 210, 212 and corresponding grooves 211, 213 extend throughout the entire length of the lower rail 204. It is further of consequence to note that the projection 198 is appreciably narrower than the space between the projections 205, 206 of the lower rail 204. Similarly the projection 206 of the lower rail 204 is narrower than the space between the projections 198, 199 of the mounting block 190.

In operation when the handrail assembly, of which the lower rail 204 is part, is to be mounted, the projection 206 will extend downwardly until it rests on the top plate 197. At the same time the bottom wall 207 of the lower rail 204 will rest upon the projection 198. Here again the projection 198 is materially narrower than the space between the projections 205, 206. The difference in width is great enough to provide a space between the projection 198 and the projection 206 wide enough so that a solid wedge 214 can be driven into it firmly enough to anchor the lower rail 204 to the mounting block 190, at whatever the location may be. Conversely, for dismounting the handrail assembly all that is needed is to drive the wedge 214 free and shift the projections clear of each other.

When a pedestrian walkway is to be equipped with an appropriate handrail, mounting blocks are installed along the line of the rail. The line of the rail may be of any required length or number of lengths and with corners to be turned whereever needed. Spaces between corners may vary in length depending on architectural needs.

Once the lengths of the straightaway distances and corner connections are known, stock lengths of the handrail assemblies may be assembled and then cut to sectional lengths needed to complete the needs of the installation, whatever those lengths may be. When finally cut to size, the cut lengths are attached to the already installed mounting blocks. Adjacent ends of the handrail assemblies are made to join each other as needed when multiple stock lengths may be needed for walkways which exceed the stock length of the assemblies. For multiple length installations pairs of mounting blocks in alignment may be provided at the junctions.

Where prospective locations of the mounting blocks are well established in advance, those blocks may be initially attached to the lower rails and then readjusted, if need be, at the job site, wherever bolts are to be installed in the supporting surface.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A postless handrail assembly comprising an upper rail, a lower rail and pickets for assembly into a composite section for erection on a supporting surface, said pickets having a length determinative of the height of said assembly and being at spaced locations along the length of the assembly, said pickets each having an upper end and a lower end, at least one of said upper rail and said lower rail being extruded stock of closed tubular cross-section having longitudinally continuous picket engaging means formed interiorly to said rails and integrally therewith, said least one of said rails further having holes diametrically opposed to said picket engaging means and spaced therealong for admitting said picket end into engagement with said picket engaging means, one of said picket engaging means and said picket end being deformable in response to force applied by urging of said pickets against said least one of said rails for making interlocking engagement therebetween.

2. A postless handrail assembly as in claim 1 further comprising handrail mounting means wherein there is a contact medium on the lower rail extending throughout the length of the assembly for engagement with a complementary contact medium on an upper section of said mounting means.

3. A postless handrail assembly as in claim 2 wherein the contact medium of the lower rail is a recess extending throughout the length of the lower rail, the complementary contact medium is a complementary recess in the mounting and there is key means extendable into said recesses whereby to provide an interlock between said lower rail and said mounting.

4. A postless handrail assembly as in claim 3 wherein there is a lower face on the lower rail and an upper face on the mounting for face to face engagement with each other whereby corresponding recess means form a common pocket for reception of said key means.

5. A postless handrail assembly as in claim 1 wherein each said picket has a longitudinal axis and said longitudinal axis of adjacent pickets are displaced relative to each other at the junction of the pickets with said lower rail.

6. A postless handrail assembly as in claim 5 wherein the longitudinal axis of at least some of the pickets adjacent one end of the picket is displaced laterally relative to the longitudinal axis adjacent the other end of the picket.

7. A postless handrail assembly of claim 1 wherein said lower rail further comprises continuous longitudinally extending first means integral therewith, and further comprising a plurality of mountings for supporting the assembly on the supporting surface, clamp means associated with each of said mountings for rigidly connecting said mountings to said first means of said lower rail at any location along said lower rail including interlocking elements between said first means and said mounting adapted to retain said lower rail and mounting in an assembled configuration.

8. A postless handrail assembly of claim 7 wherein said clamp means biases said interlocking elements into torsionally rigid engagement.

9. A postless handrail assembly as in claim 8 wherein said clamp means is a deformable plate.

10. A postless handrail assembly as in claim 8 wherein said clamp means is a screw activated block.

11. A postless handrail assembly comprising an upper rail, a lower rail and closed hollow pickets for assembly into a composite section for erection on a supporting surface, said pickets having a length determinative of the height of said assembly and being at spaced locations throughout the length of the assembly, said pickets each having an upper end and a lower end, said upper rail and said lower rail being extruded stock of closed tubular cross-section having picket engaging means formed interiorly to said rails and integrally therewith, Said rails further having holes spaced therealong for admitting said picket end into engagement with said picket engaging means, said picket engaging means being deformable in response to force applied by urging of said pickets for making interlocking engagement with the picket ends, a plurality of mountings for supporting the assembly on the supporting surface at any location along the lower rail, first interlocking means integral with and longitudinally continuous along said lower rail and second interlocking means integral with said mounting adapted to retain said lower rail and the mounting in an assembled configuration, and resilient clamp means for biasing said interlocking elements into torsionally rigid interengagement.

12. A postless handrail as in claim 11 wherein the interlocking elements comprise adjacent faces on the lower rail and the mounting.

13. A postless handrail as in claim 11 wherein the interlocking elements comprise tongue and groove members.

14. A postless handrail assembly as in claims 1 or 11 wherein said picket engaging means comprises a deflecting agent on an inside wall of said least one of said rails in alignment with the corresponding end of the picket, and a deflection responsive agent on the picket at the corresponding end of the picket.

15. A postless handrail assembly as in claim 14 wherein said deflecting agent comprises oppositely located fingers extending from the wall of the rail toward the end of the picket.

16. A postless handrail assembly as in claim 14 wherein said deflection responsive agent comprises recessed portions of the picket.

17. A postless handrail assembly as in claim 14 wherein said deflecting agent comprises oppositely located fingers extending from the wall of the rail obliquely inwardly toward the end of the picket and said deflection responsive agent comprises recessed portions of the picket extending in a direction transverse with respect to the direction of the fingers.

18. A postless handrail assembly as in claims 1 or 11 wherein said picket engaging means comprises a recess in a wall section of the rail opposite the corresponding end of the picket with obliquely directed side wall sections having a size and configuration complementary with respect to the size and configuration of the corresponding end of the picket.

19. A postless handrail assembly as in claim 18 wherein there is an auxiliary attachment between the picket and the rail comprising a substantially expanded wall portion of the picket in engagement with a portion of the wall of the upper rail.

20. A postless handrail assembly as in claims 1 or 11 wherein said picket engaging means comprises a pair of recesses in an interior wall of the rail extending obliquely to each other and further comprising end sections of said picket lodged in binding engagement within corresponding ones of said recesses.

21. In a preassembled handrail structure for installation on a supporting surface without resort to conventional posts and wherein hollow upper and lower extruded rails of closed tubular cross section with a pressure responsive picket clamp formed integrally along each of said rails have an array of individual hollow tubular pickets supported therebetween, the method for assembly and use of the handrail structure comprising the steps of:

forming a series of longitudinally spaced picket receptive apertures spaced along each said rail, placing said pickets in the picket receptive apertures of both of said rails so that each picket extends into a corresponding picket receptive aperture of each said rail, moving said upper and lower rails against corresponding ends of the pickets with a force sufficient to rigidly anchor the ends of the pickets in the corresponding picket clamps of said rails thereby to create a torsionally rigid composite assembly of handrails and pickets for subsequent mounting on the supporting surface, mounting a plurality of mounting members on said supporting surface, combining a rail interlocking element provided integrally on said lower rail with a mounting interlocking element on each said mounting member to assemble said rigid composite assembly to said mounting members, and actuating a resilient clamping member to bias said interlocking elements into torsionally rigid interengagement.

22. The method of claim 21 including forming a mounting configuration extending throughout substantially the length of the lower rail and attaching the lower rail to the supporting surface at arbitrarily spaced locations along the length of the mounting configuration.

23. The method of claim 21 including forming a plurality of mounting blocks with relatively separable opposite sides, forming recesses on inwardly directed faces of the opposite sides and complementary with respect to the shape of the lower rail and erecting the handrail structure on the mounting blocks by drawing said opposite sides into engagement with the lower rail.

24. The method of claim 21 including offsetting longitudinal axes of the pickets with respect to each other at junctions of the pickets with at least one of the rails whereby to generate a torsion condition for improving rigidity of the handrail structure.

25. The method of claim 21 including offsetting a portion of the longitudinal axis at one end of the respective pickets with respect to a portion of the longitudinal axis at the other end in a direction so that alternate pickets engage one of the rails on opposite sides of the longitudinal center line of said one rail.

26. The method of claim 24 or 25 including offsetting lower ends of the pickets laterally with respect to the longitudinal axis of the lower rail.

27. The method of claim 21 wherein the rail interlocking element comprises a rail mounting channel extending substantially the length of the lower rail, and further comprising the steps of forming a plurality of mounting blocks wherein the mounting interlocking element comprises a mating mounting channel, anchoring the mounting blocks at spaced locations on the supporting surface and fastening the mounting blocks to the lower rail by means of said rail mounting channel at those locations where the lower rail is in engagement with the mounting blocks.

* * * * *